US010704389B2

(12) United States Patent
Mirabile et al.

(10) Patent No.: US 10,704,389 B2
(45) Date of Patent: Jul. 7, 2020

(54) SYSTEM FOR RE-TENSIONING MINE ROOF CHANNELS

(71) Applicant: FCI Holdings Delaware, Inc., Wilmington, DE (US)

(72) Inventors: Ben Mirabile, Lerona, WV (US); Brandon Shane Stables, Princeton, WV (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 16/351,626

(22) Filed: Mar. 13, 2019

(65) Prior Publication Data

US 2019/0292909 A1 Sep. 26, 2019

Related U.S. Application Data

(60) Provisional application No. 62/645,273, filed on Mar. 20, 2018.

(51) Int. Cl.
*E21D 21/00* (2006.01)
*E21D 11/00* (2006.01)

(52) U.S. Cl.
CPC ..... *E21D 21/0046* (2013.01); *E21D 11/006* (2013.01); *E21D 21/008* (2013.01); *E21D 21/0086* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,445,808 | A * | 5/1984 | Arya | E21D 21/0086 405/302.1 |
| 5,733,069 | A | 3/1998 | Schofield, Jr. | |
| 6,146,056 | A * | 11/2000 | Calandra, Jr. | E21D 21/0086 405/288 |
| 6,637,980 | B2 | 10/2003 | Robertson, Jr. | |
| 7,625,155 | B1 * | 12/2009 | McKinney | E21D 21/008 405/259.1 |
| 8,740,504 | B2 | 6/2014 | Oldsen et al. | |
| 2009/0191007 | A1 * | 7/2009 | Seegmiller | E21D 21/008 405/259.5 |

* cited by examiner

*Primary Examiner* — Kyle Armstrong
(74) *Attorney, Agent, or Firm* — The Webb Law Firm

(57) ABSTRACT

A system for re-tensioning mine roof channels includes a roof plate having a first side, a second side positioned opposite the first side, and a sidewall extending therebetween, where the first side is configured to engage a surface of a mine roof, and where the sidewall defines a radially extending slot configured to receive a mine roof bolt. The system also includes a spacer having a first side, a second side positioned opposite the first side, and a sidewall extending therebetween, with the first side of the spacer configured to engage with the second side of the roof plate, and the sidewall defining a slot configured to receive a mine roof bolt, and a nut having a first side, a second side positioned opposite the first side, a sidewall therebetween, and a threaded opening, with the sidewall defining a radially extending slot configured to receive a mine roof bolt.

17 Claims, 10 Drawing Sheets

SYSTEM FOR RE-TENSIONING MINE ROOF CHANNELS

This application is based on U.S. Provisional Application No. 62/645,273, filed Mar. 20, 2018, on which priority of this patent application is based and which is incorporated herein by reference in its entirety.

BACKGROUND OF THE INVENTION

Field of the Invention

The present invention relates to a system and method for re-tensioning a loose roof plate that has become loose in an underground mine, such as a coal mine.

Description of Related Art

Surface mining and deep underground mining are the two basic methods of mining coal. Coal seams relatively close to the surface are usually surface mined, whereas coal seams occurring at greater depths are usually mined underground. Underground mining accounts for most of world's coal production.

In underground mining, roof bolting has been an important technological development for supporting the roof of an underground mine. In roof bolting, bolts are installed within a rock mass to reinforce and stabilize the rock formation above the mine tunnel. Conventionally, it is common practice to drill a hole through a mine tunnel ceiling into the rock formation above. A roof plate is then mounted on to the head of a roof bolt that is installed into the hole. The roof plate is then brought up against the mine ceiling as the roof bolt is tightened into place, allowing the roof plate to apply a pressure against the roof of the tunnel.

Over time, the roof layer just above the roof plate may crumble and flake, causing the roof plate to loosen. Support of the roof is compromised because the loose roof plate is no longer applying pressure against the roof of the tunnel. Related art tensioning devices have attempted to solve this problem by reestablishing contact between the roof and the loose roof plate. See, for example, the systems shown and described in U.S. Pat. Nos. 5,733,069; 6,637,980; and 8,740,504.

In certain installations, a plurality of mine roof bolts are installed through openings in a roof channel that abuts the mine roof. The roof channel is typically a steel channel having one or more longitudinal ribs to increase the rigidity and strength of the channel. The roof layer above the roof channel may deteriorate and crumble causing a gap between the mine roof and the roof channel and leading to a loss of tension of the bolt. Due to the presence of the roof channel, which typically cannot be removed for a single bolt, conventional solutions for re-tensioning the bolt and channels are unsuitable.

SUMMARY OF THE INVENTION

The present disclosure is directed to a system for re-tensioning mine roof channels which may comprise a roof plate having a first side, a second side positioned opposite the first side, and a sidewall extending therebetween, wherein the first side is configured to engage a surface of a mine roof, and wherein the sidewall defines a radially extending slot configured to receive a mine roof bolt; a spacer having a first side, a second side positioned opposite the first side, and a sidewall extending therebetween, wherein the first side of the spacer is configured to engage with the second side of the mine roof plate, and wherein the sidewall defines a radially extending slot configured to receive a mine roof bolt; and a nut having a first side, a second side positioned opposite the first side, a sidewall therebetween, and a threaded opening, wherein the sidewall defines a radially extending slot configured to receive a mine roof bolt.

In some embodiments or aspects of the present disclosure, the system may also have a spacer plate having a first side, a second side positioned opposite the first side, and a sidewall extending therebetween, wherein the sidewall defines a radially extending slot configured to receive the mine roof bolt, wherein the first side of the spacer plate is configured to engage the second side of the nut, and the second side of the spacer plate is configured to engage a mine roof channel. The spacer sidewall may have a threaded outer surface. The threaded opening of the nut may be configured to engage with the threaded outer surface of the spacer sidewall. The spacer may have a thickness of 0.5-3 inches between the first and second sides of the spacer, and the nut may have a thickness of 0.5-3 inches between the first and second sides of the nut.

In other embodiments or aspects of the present disclosure, the system may further comprise a supplemental spacer having a first side, a second side positioned opposite the first side, and a sidewall extending therebetween, wherein the sidewall defines a radially extending slot configured to receive the mine roof bolt, wherein the first side of the supplemental spacer is configured to engage with the second side of the roof plate, and the second side of the supplemental spacer is configured to engage with the first side of the spacer. The first side of the spacer may define a recessed surface configured to receive the supplemental spacer. The roof plate may have a key extending from the second side of the roof plate, wherein the radially extending slot of the spacer is configured to receive the key to prevent relative rotation between the spacer and the roof plate. The key of the roof plate may be parallelpiped in shape.

In other embodiments or aspects of the present disclosure, the roof plate may have at least one projection extending from the first side of the roof plate, wherein at least one projection is configured to engage with the mine roof surface to prevent movement of the roof plate relative to the mine roof surface. The mine roof plate may be substantially rectangular in shape having four corners, wherein at least one projection extends from the first side of the roof plate in each of the four corners. The system may further comprise a mine roof channel, having a first side, a second side, and a sidewall extending therebetween, wherein the mine roof channel is configured to engage the mine roof bolt, and the first side of the mine roof channel is configured to engage the second side of the spacer plate. The system may also further comprise a mine roof bolt having a shaft and a bolt head, wherein the mine roof bolt is configured to be inserted into a borehole in a mine roof.

In yet another embodiment or aspect of the present disclosure, a method for re-tensioning a mine roof channel held by a mine roof bolt to a mine roof, wherein the mine roof bolt comprises a mine roof shaft may comprise placing a roof plate between the mine roof channel and the mine roof by inserting the shaft of the roof bolt into a radially extending slot of the roof plate; placing a spacer having a threaded outer surface between the mine roof channel and the roof plate by inserting the shaft of the roof bolt into a radially extending slot of the spacer; placing a nut between the mine roof channel and the spacer by inserting the shaft of the roof bolt into a radially extending slot of the nut; threading the nut onto the spacer while rotation of the spacer to the roof plate is restricted; and tightening the nut until the roof plate is firmly pressed against the roof. The method may further comprise placing a spacer plate between the mine roof channel and the nut by inserting the shaft of the roof bolt into a radially extending slot of the spacer plate. The method may also comprise placing a supplemental spacer between the spacer and the roof plate by inserting the shaft of the roof bolt into a radially extending slot of the supplemental spacer. The method may also include a projection extending from the roof plate and configured to be received by at least the spacer in order to prevent relative rotation between the roof plate and the spacer. The projection may be parallelepiped in shape.

In some embodiments or aspects, the present disclosure may be characterized by one or more of the following clauses.

Clause 1: A system for re-tensioning mine roof channels comprising: a roof plate having a first side, a second side positioned opposite the first side, and a sidewall extending therebetween, wherein the first side is configured to engage a surface of a mine roof, wherein the sidewall defines a radially extending slot configured to receive a mine roof bolt; a spacer having a first side, a second side positioned opposite the first side, and a sidewall extending therebetween, wherein the first side of the spacer is configured to engage with the second side of the roof plate and wherein the sidewall defines a radially extending slot configured to receive a mine roof bolt; and a nut having a first side, a second side positioned opposite the first side, a sidewall therebetween, and a threaded opening, wherein the sidewall defines a radially extending slot configured to receive a mine roof bolt.

Clause 2. The system for re-tensioning mine roof channels of clause 1, further comprising a spacer plate having a first side, a second side positioned opposite the first side, and a sidewall extending therebetween, wherein the sidewall defines a radially extending slot configured to receive the mine roof bolt, wherein the first side of the spacer plate is configured to engage the second side of the nut, and the second side of the spacer plate is configured to engage a mine roof channel.

Clause 3. The system for re-tensioning mine roof channels of clause 1 or 2, wherein the spacer sidewall has a threaded outer surface.

Clause 4. The system for re-tensioning mine roof channels of any of clauses 1-3, wherein the threaded opening of the nut is configured to engage the threaded outer surface of the spacer sidewall.

Clause 5. The system for re-tensioning mine roof channels of any of clauses 1-4, wherein the spacer has a thickness of 0.5-3 inches between the first and second sides of the spacer.

Clause 6. The system for re-tensioning mine roof channels of any of clauses 1-5, wherein wherein the nut has a thickness of 0.5-3 inches between the first and second sides of the nut.

Clause 7. The system for re-tensioning mine roof channels of any of clauses 1-6, further comprising a supplemental spacer having a first side, a second side positioned opposite the first side, and a sidewall extending therebetween, wherein the sidewall defines a radially extending slot configured to receive the mine roof bolt, wherein the first side of the supplemental spacer is configured to engage with the second side of the roof plate, and the second side of the supplemental spacer is configured to engage with the first side of the spacer.

Clause 8. The system for re-tensioning mine roof channels of any of clauses 1-7, wherein the first side of the spacer defines a recessed surface configured to receive the supplemental spacer.

Clause 9. The system for re-tensioning mine roof channels of any of clauses 1-8, wherein the roof plate has a key extending from the second side of the roof plate, and wherein the radially extending slot of the spacer is configured to receive the key to prevent relative rotation between the spacer and the roof plate.

Clause 10. The system for re-tensioning mine roof channels of any of clauses 1-9, wherein the key of the roof plate is parallelpiped in shape.

Clause 11. The system for re-tensioning mine roof channels of any of clauses 1-10, wherein the roof plate has at least one projection, extending from the first side of the roof plate, wherein the at least one projection is configured to engage with the mine roof surface to prevent movement of the roof plate relative to the mine roof surface.

Clause 12. The system for re-tensioning mine roof channels of any of clauses 1-11, wherein the roof plate is substantially rectangular in shape having four corners, wherein at least one projection extends from the first side of the roof plate in each of the four corners.

Clause 13. The system for re-tensioning mine roof channels of any of clauses 1-12, further comprising a mine roof channel, having a first side, a second side, and a sidewall extending therebetween, wherein the mine roof channel is configured to engage the mine roof bolt, and the first side of the mine roof channel is configured to engage the second side of the spacer plate.

Clause 14. The system for re-tensioning mine roof channels of any of clauses 1-13, further comprising a mine roof bolt having a shaft and a bolt head, wherein the mine roof bolt is configured to be inserted into a borehole in a mine roof.

Clause 15. A method for re-tensioning a mine roof channel held by a mine roof bolt to a mine roof, wherein the mine roof bolt comprises a mine roof shaft, the method comprising: placing a roof plate between the mine roof channel and the mine roof by inserting the shaft of the roof bolt into a radially extending slot of the roof plate; placing a spacer having a threaded outer surface between the mine roof channel and the roof plate by inserting the shaft of the roof bolt into a radially extending slot of the spacer; placing a nut between the mine roof channel and the spacer by inserting the shaft of the roof bolt into a radially extending slot of the nut; threading the nut onto the spacer while rotation of the spacer to the roof plate is restricted; and tightening the nut until the roof plate is firmly pressed against the roof.

Clause 16. The method for re-tensioning a mine roof channel of clause 15, further comprising placing a spacer plate between the mine roof channel and the nut by inserting the shaft of the roof bolt into a radially extending slot of the spacer plate.

Clause 17. The method for re-tensioning a mine roof channel of clause 15 or 16, further comprising placing a supplemental spacer between the spacer and the roof plate by inserting the shaft of the roof bolt into a radially extending slot of the supplemental spacer.

Clause 18. The method for re-tensioning a mine roof channel of any of clauses 15-17, wherein a projection extends from the roof plate and is configured to be received by at least the spacer in order to prevent relative rotation between the roof plate and the spacer.

Clause 19. The method for re-tensioning a mine roof channel of any of clauses 15-18, wherein the projection is parallelepiped in shape

DETAILED DESCRIPTION OF THE INVENTION

Figure 1:
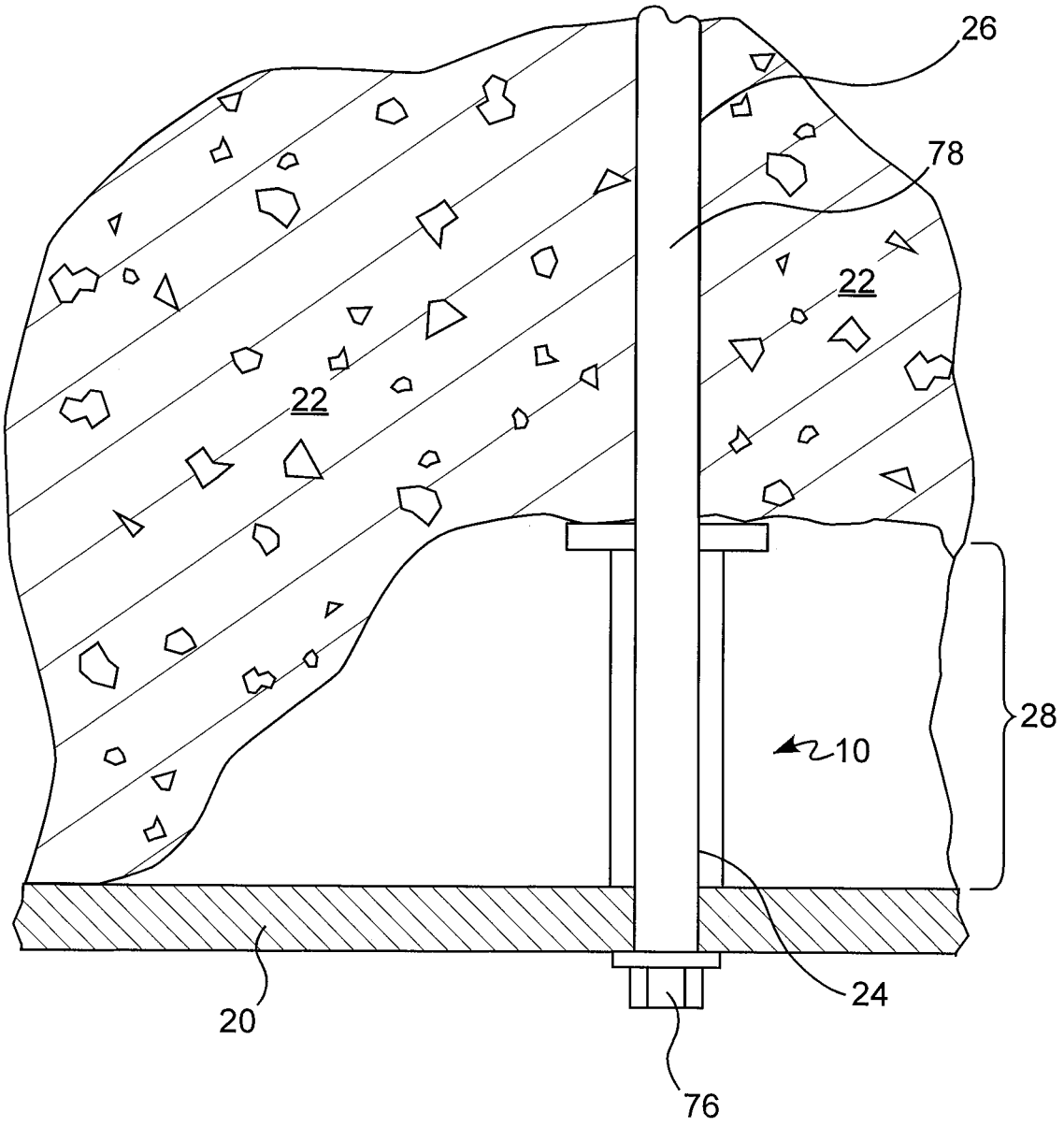
FIG. 1 is a schematic view of a system for re-tensioning mine roof channels according to one aspect of the present invention.

As used herein, the singular form of "a", "an", and "the" include plural referents unless the context clearly dictates otherwise.

Spatial or directional terms, such as "left", "right", "inner", "outer", "above", "below", and the like, relate to the disclosure as shown in the drawing figures and are not to be considered as limiting as the disclosure can assume various alternative orientations.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

The term "at least" is synonymous with "greater than or equal to".

The term "not greater than" is synonymous with "less than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

The present disclosure is directed to a system for re-tensioning mine roof channels 10 and a method for such re-tensioning. Unlike other mine roof re-tensioning systems and methods, the present disclosure results in re-tensioning occurring between the mine roof channel and the mine roof in a repeatable manner. The re-tensioning system provides for additional engagements with the mine roof and repeated re-tensioning if the mine roof channel loosens.

Referring to FIG. 1, a mine roof channel 20 is held in place and abuts a mine roof or rock strata 22 by a mine roof bolt 24. The mine roof bolt 24 may have a shaft 78 that extends through an opening of the mine roof channel 20 and is inserted into a borehole 26 within the mine roof 22. The mine roof bolt 24 may be installed and secured within the borehole 26 in a conventional manner using a mechanical anchor (such an expansion shell assembly), grout (such as resin, polyurethane, cementitious material, etc.), or a combination of anchoring arrangements. The mine roof bolt 24 has a bolt head 76 that engages the side of the mine roof channel 20 facing away from the mine roof 22. After being inserted into the borehole 26, the bolt head 76 is tightened against the mine roof channel 20 to hold the mine roof channel 20 in place against the mine roof 22.

Over time the mine roof 22 may deteriorate or fall apart creating a gap 28 between the mine roof 22 and mine roof channel 20. The gap 28 may reduce the compressive force applied to the mine roof 22 by the mine roof channel 20 causing the mine roof channel 20 to loosen to some degree against the mine roof 22 thus creating a potentially dangerous environment. Therefore, a re-tensioning system 10 may be applied between the mine roof 22 and the mine roof channel 20 in order to keep the mine roof channel 20 tightly in place.

As shown in FIGS. 1-3 and 19, a system for re-tensioning mine roof channels 10 includes a roof plate 12, a spacer 14, a nut 16, and a spacer plate 18. The system 10 may also include a supplemental spacer 13. Each component of the system 10 has radially extending slots in order to engage with the mine roof bolt 24 between the mine roof channel 20 and the mine roof 22. After the roof plate 12, spacer 14, nut 16, and spacer plate 18 are engaged with the mine roof bolt 24, the system 10 may re-tension the mine roof channel 20 against the mine roof 22 in the area of the gap 28. The details of each element and the re-tensioning will be described in more detail herein.

Referring now to FIGS. 4-7, the roof plate 12 includes a first side 64, a second side 66 positioned opposite the first side 64, and a sidewall 65 extending between both sides. The sidewall 65 defines a radially extending slot 68 which is configured to receive and engage the mine roof bolt 24. The first side 64 of the roof plate 12 is configured to engage the mine roof surface 22. The second side 66 is configured to engage with other elements of the re-tensioning system 10 located below the roof plate 12 along the mine roof bolt 24. The second side 66 also has a key 70 extending therefrom. The key 70 engages with the elements of the re-tensioning system below the roof plate 12, such as the spacer 14 in order to prevent relative rotation between the roof plate 12 and elements of the re-tensioning system 10 located below the roof plate 12. In the present embodiment, the key 70 is a parallelpiped projection configured to engage with the spacer 14. It is contemplated that the key 70 may take any shape and be configured in any manner in order to prevent relative rotation between the roof plate 12 and other elements of the mine re-tensioning system 10. For example, the key 70 may be detachably mounted to the roof plate 12 and be connected to the roof plate 12 before installation of the system 10.

Figure 6:
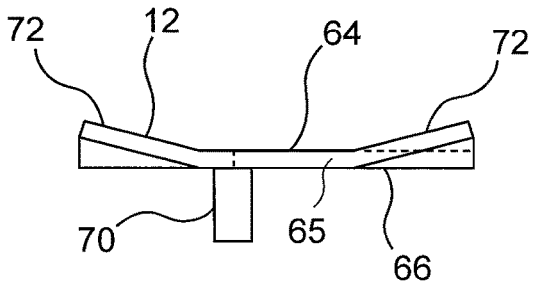
FIG. 6 is a front view of the roof plate of FIG. 4.
Figure 7:
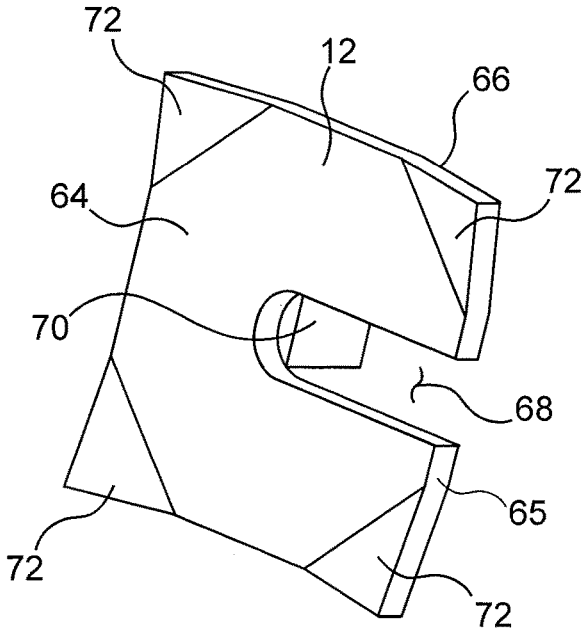
FIG. 7 is a perspective view of the roof plate of FIG. 4.
Figure 8:
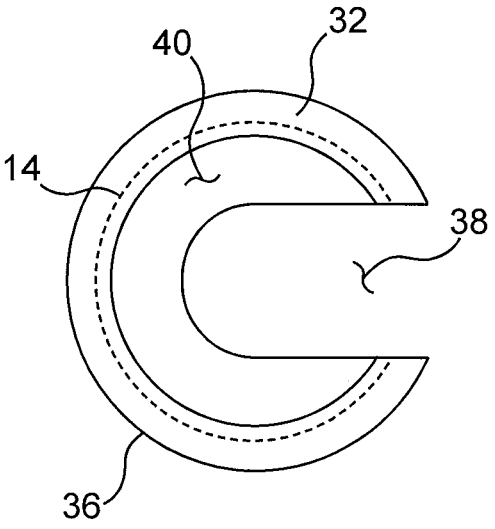
FIG. 8 is a top view of a spacer of the system of FIG. 1 according to one aspect of the present invention.
Figure 9:
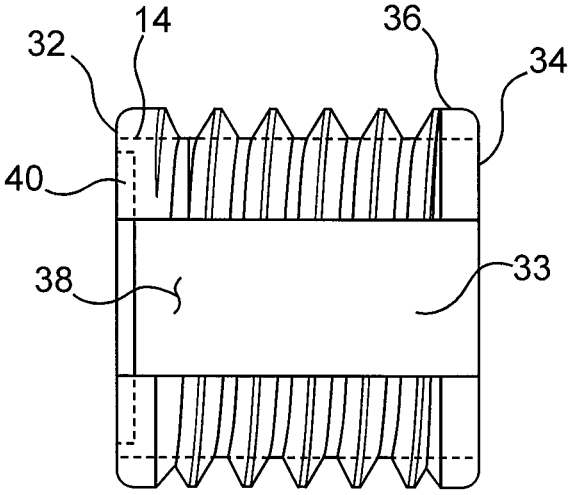
FIG. 9 is a side view of the spacer of FIG. 8.
Figure 10:
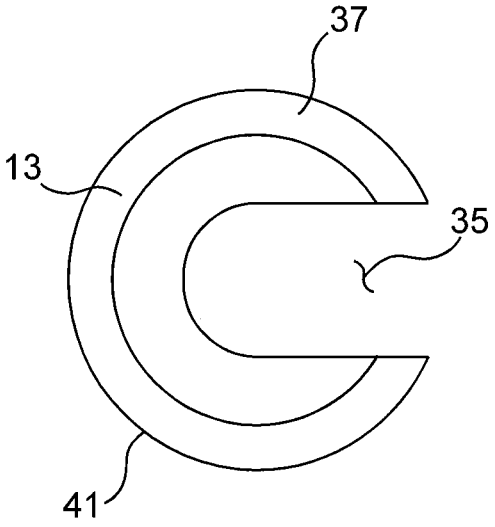
FIG. 10 is a top view of a supplemental spacer of the system of FIG. 1 according to one aspect of the present invention.
Figure 11:
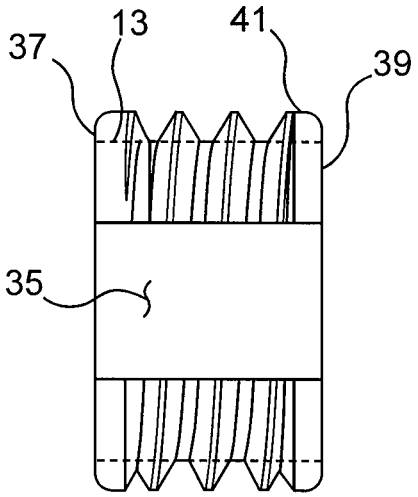
FIG. 11 is a side view of the supplemental spacer of FIG. 10.

In order to engage with the mine roof surface 22, the first side 64 of the roof plate 12 has one or more projections 72. These projections 72 are configured to bite or dig into the mine roof 22 in order to prevent movement of the roof plate 12 relative to the mine roof surface 22. In the present embodiment, the roof plate 12 is substantially rectangular in shape with a projection 72 extending from the first side 64 in each of the corners of the roof plate 12. The projections 72 may extend from the first side 64 of the roof plate 12 or the projections may be portions of the first side 64 configured to be angled upwards to engage with the mine roof surface 22. For example, as shown in FIG. 6, the corners of the substantially rectangular roof plate 12 are angled upwards to form the projections 72. It is also contemplated that the roof plate 12 may take other shapes such as a circle, oval, or triangle, and the roof plate 12 may have any number of projections 72 extending from the first side 66 in any location along the first side 66 where it may be beneficial to have the projections 72 engage with the mine roof surface 22.

Referring now to FIGS. 8-11, a spacer 14 engages with the mine roof bolt 24 and abuts the roof plate 12. The spacer 14 has a first side 32, a second side 34 positioned opposite the first side 32, and a sidewall 33 extending therebetween. The sidewall 33 has a threaded outer surface 36. The threaded outer surface 36 is configured to engage with a threaded inner surface of the nut 16 which will be described in more detail below. The sidewall 33 defines another radially extending slot 38 configured to receive and engage at least the mine roof bolt 24. The slot 38 may also receive and engage the key 70 extending from the second side 66 of the roof plate 12 in order to prevent relative rotation between the roof plate 12 and the spacer 14. The first side 32 is configured to engage and abut the second side 66 of the roof plate 12. The first side 32 may also define a recessed surface 40. The recessed surface 40 is configured to receive a supplemental spacer 13 for certain instances where it may be beneficial to have a second spacer in order to take up more space within the gap 28 due to the size of the gap 28 between the mine roof channel 20 and the mine roof 22. The recessed surface 40 is configured to engage with a second side 39 of the supplemental spacer 13. In this instance, a first side 37 of the supplemental spacer 13 engages with and abuts the roof plate 12 instead of the spacer 14. The supplemental spacer's 13 cooperation with the spacer 14 may be the same as in U.S. Pat. No. 8,740,504, which is hereby incorporated by reference in its entirety. Like the spacer 14, the supplemental spacer 13 may also have a threaded outer surface 41 to engage with a threaded inner surface of the nut 16 and a radial opening 35 configured to receive and engage at least the mine roof bolt 24. Although FIGS. 2, 3, 10, and 11 show the supplemental spacer 13 with a threaded outer surface 41, it is contemplated that the outer surface may not be threaded.

The spacer 14 may be provided in a plurality of thicknesses to accommodate varying size gaps 28 between the mine roof 22 and the mine roof channel 20. In one example, the spacer 14 is provided with a first thickness of 2¼ inches. In a further example, the spacer 14 is provided with a second thickness of 1 inch. It is contemplated that the spacer 14 may have any thickness necessary to accommodate the size of the gap 28 between the mine roof 22 and the mine roof channel 20. The supplemental spacer 13 may also be provided with varying thicknesses depending on the size of the first spacer 14 and the size of the gap 28. The spacer 14 and supplemental spacer 13 may be cylindrical, although it is contemplated that other suitable configurations, such as a hexagonal prism, may be utilized. It is further contemplated that the radially extending slot 38 of the spacer 14 and the supplemental spacer 13 may take any configuration necessary to receive and engage the mine roof bolt 24 and to receive the key 70 from the roof plate 12.

Referring now to FIGS. 12-16, a nut 16 has a first side 44, a second side 46 positioned opposite the first side 44, and a sidewall 43 extending therebetween. The sidewall 43 has a threaded inner surface 48 configured to engage the threaded outer surface 36 of the spacer 14. After threading the nut 16 and the spacer 14, the first side 44 may engage with the second side of the roof plate 66 or there may be a gap therebetween. The side wall 43 also defines a radially extending slot 50 configured to receive and engage the mine roof bolt 24. In instances where the shaft 78 of the mine roof bolt 24 is also threaded, the nut 16 may thread around the shaft 78. In this instance, the first side 44 of the nut 16 engages with the second side 34 of the spacer 14 providing a compressive force against the spacer 14 and the roof plate 12.

Figure 12:
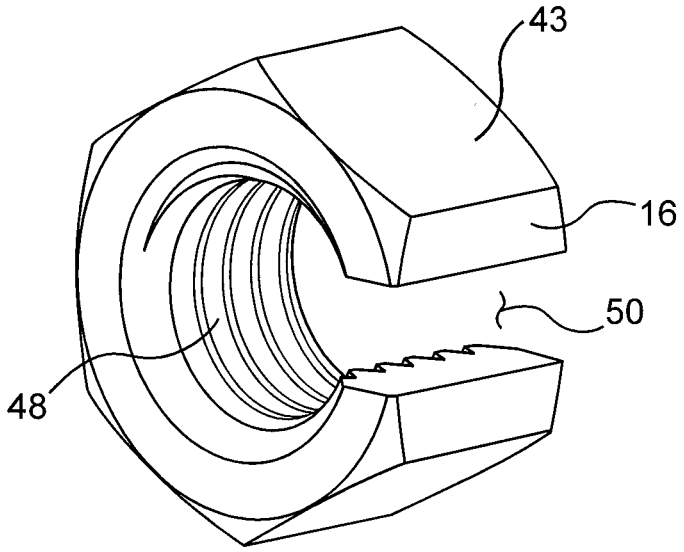
FIG. 12 is a perspective view of a nut of the system of FIG. 1 according to one aspect of the present invention.
Figure 13:
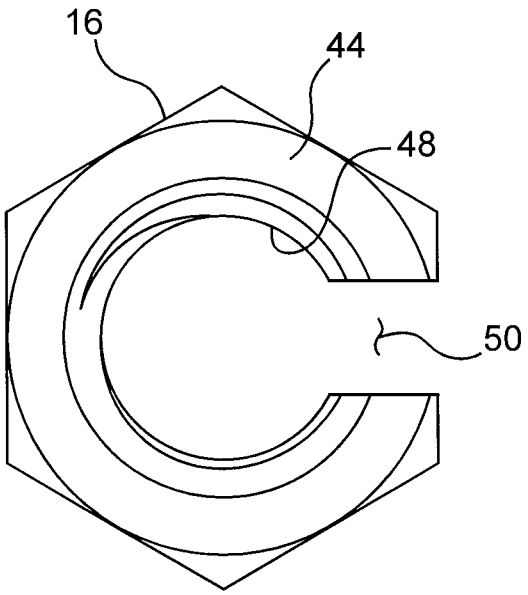
FIG. 13 is a top view of the nut of FIG. 12.
Figure 14:
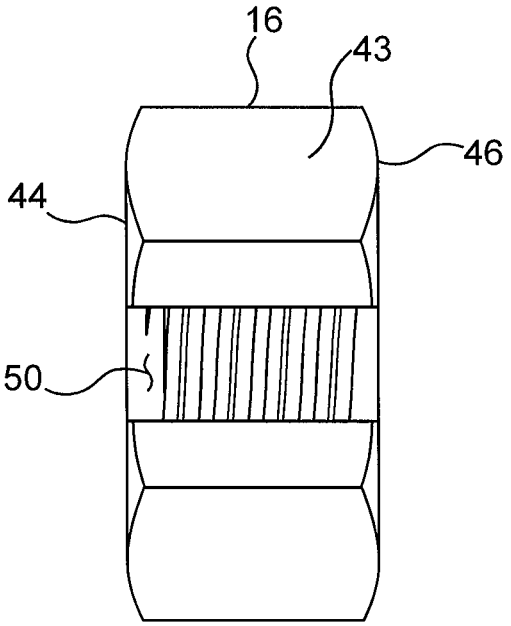
FIG. 14 is a side view of the nut of FIG. 12.
Figure 15:
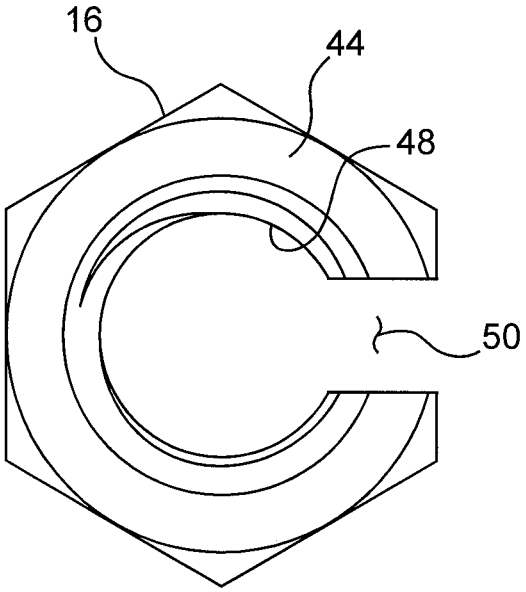
FIG. 15 is a top view of a nut of the system of FIG. 1 according to a further aspect of the present invention.
Figure 16:
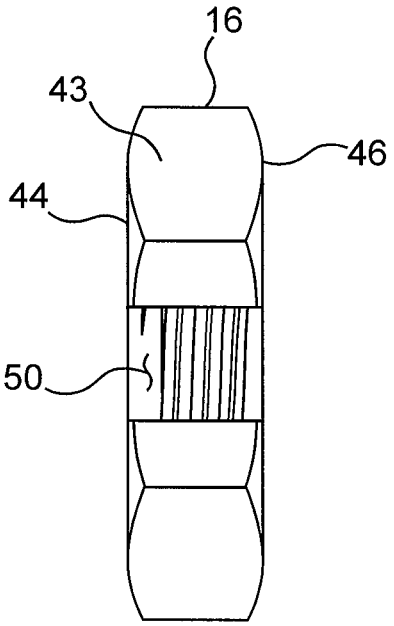
FIG. 16 is a side view of the nut of FIG. 15.
Figure 19:
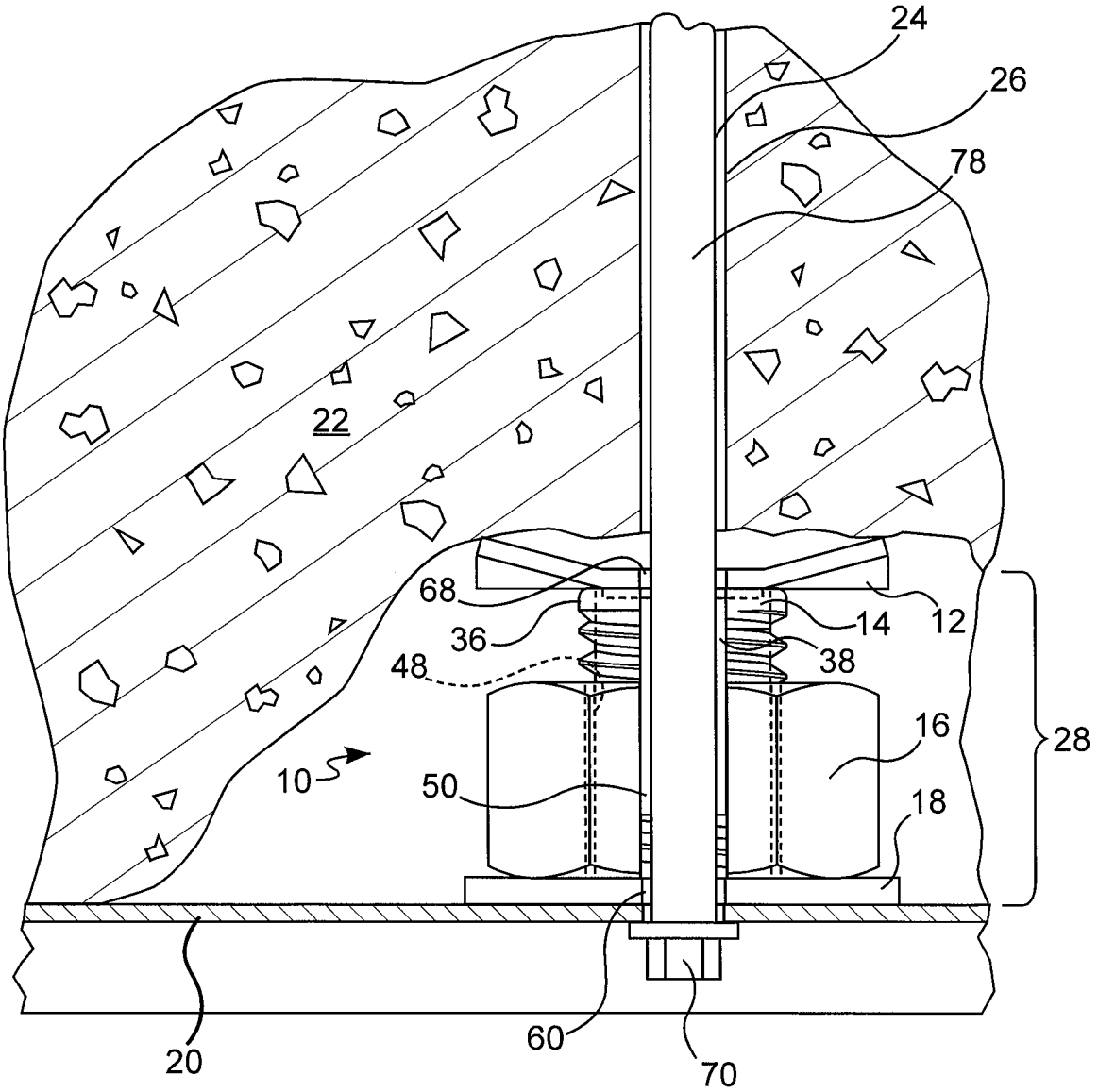
FIG. 19 is a side view of the system of FIG. 1 according to one aspect of the present invention, showing the system installed.

The nut 16 may be provided in a plurality of thicknesses to accommodate varying sizes of gaps 28 between the mine roof 22 and the mine roof channel 20. In one example, as shown in FIGS. 12-14, the nut 16 is provided with a first thickness of 2¼ inches. In a further example, as shown in FIGS. 15 and 16, the nut 16 is provided with a second thickness of 1 inch. It is contemplated that the nut 16 may have any thickness necessary to accommodate the gap 28 between the mine roof 22 and the mine roof channel 20. The size of the gap 28 between the mine roof 22 and the mine roof channel 20 also determines how far the nut 16 may be threaded up and along the threaded outer surface 36 of the spacer 14 and/or supplemental spacer 13. For example, in instances of smaller gaps 28, the nut 16 may be threaded up and along the entire length of the sidewall 33 of the spacer 14 so that the first side 44 of the nut 16 abuts the second side 66 of the roof plate 12. In instances of larger gaps 28, and as shown in FIG. 19, the nut 16 may only be threaded up and along a portion of the sidewall 33 of the spacer 14. In this instance, only the first side 32 of the spacer 14 may engage and abut the second side 66 of the roof plate 12. However, after threading the inner surface 48 of the nut 16 with only a portion of the outer surface 36 of the spacer 14, the nut 16 may still apply the compressive force necessary in order to keep the spacer 14 in place around the mine roof bolt 24 and the roof plate 12. Because the second side 39 of the supplemental spacer 13 may engage with the recessed surface 40 of the spacer 14, the supplemental spacer 13 may be too small to engage with the threaded inner surface 48 of the nut 16. In this instance, the outer surface 41 of the supplemental spacer 13 may be unthreaded, and the nut 16 may only apply a compressive force to the spacer 14. This compressive force is still sufficient to keep the spacer 14 and supplemental spacer 13 in place around the mine roof bolt 24 and the roof plate 12. In both instances of smaller and larger gaps 28, the second side 46 of the nut may still engage with and abut a first side 56 of a spacer plate 18.

Figure 17:
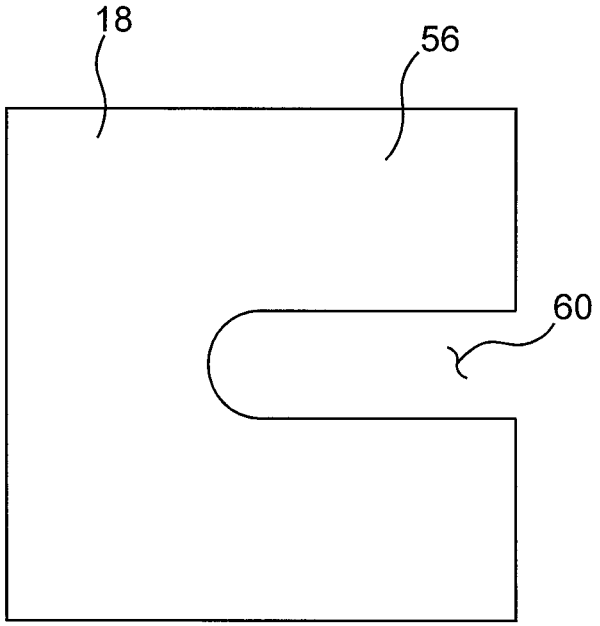
FIG. 17 is a top view of a spacer plate of the system of FIG. 1 according to one aspect of the present invention.
Figure 18:
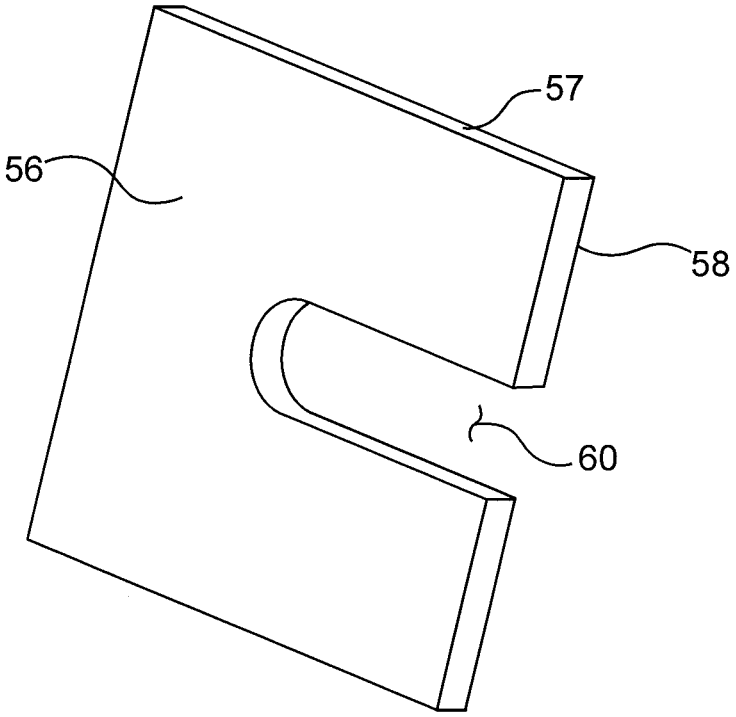
FIG. 18 is a perspective view of the spacer plate of FIG. 17.

Referring now to FIGS. 17 and 18, the spacer plate 18 has a first side 56, a second side 58 positioned opposite the first side 56, and a sidewall 57 extending therebetween. The sidewall 57 defines a radially extending slot 60 configured to receive and engage the mine roof bolt 24. The first side 56 of the spacer plate 18 engages the second side 46 of the nut and/or the second side 34 of the spacer 14. The second side 58 is configured to engage the mine roof channel 20. In particular upon installation, the spacer plate 18 is configured to be positioned between the nut 16 and the roof channel 20 and to provide a stable surface for engagement with the nut 16. Without the spacer plate 18, the nut 16 may be unstable due to the uneven surface of the loosened mine roof channel 20. It is contemplated that the spacer plate 18 may have varying degrees of thicknesses in accordance with different sizes of gaps 28 between the mine roof channel 20 and the mine roof surface 22. A thickness of the spacer plate 18 may be selected, so that, after installation of all elements of the re-tensioning system 10, the only portions of the mine roof bolt 24 within the gap 28 that are exposed to the gap 28 are those portions located within the radially extending slots of each element of the re-tensioning system 10. The portions of the mine roof bolt 24 within the gap 28 may be engaged with and surrounded by each element of the re-tensioning system 10.

Figure 2:
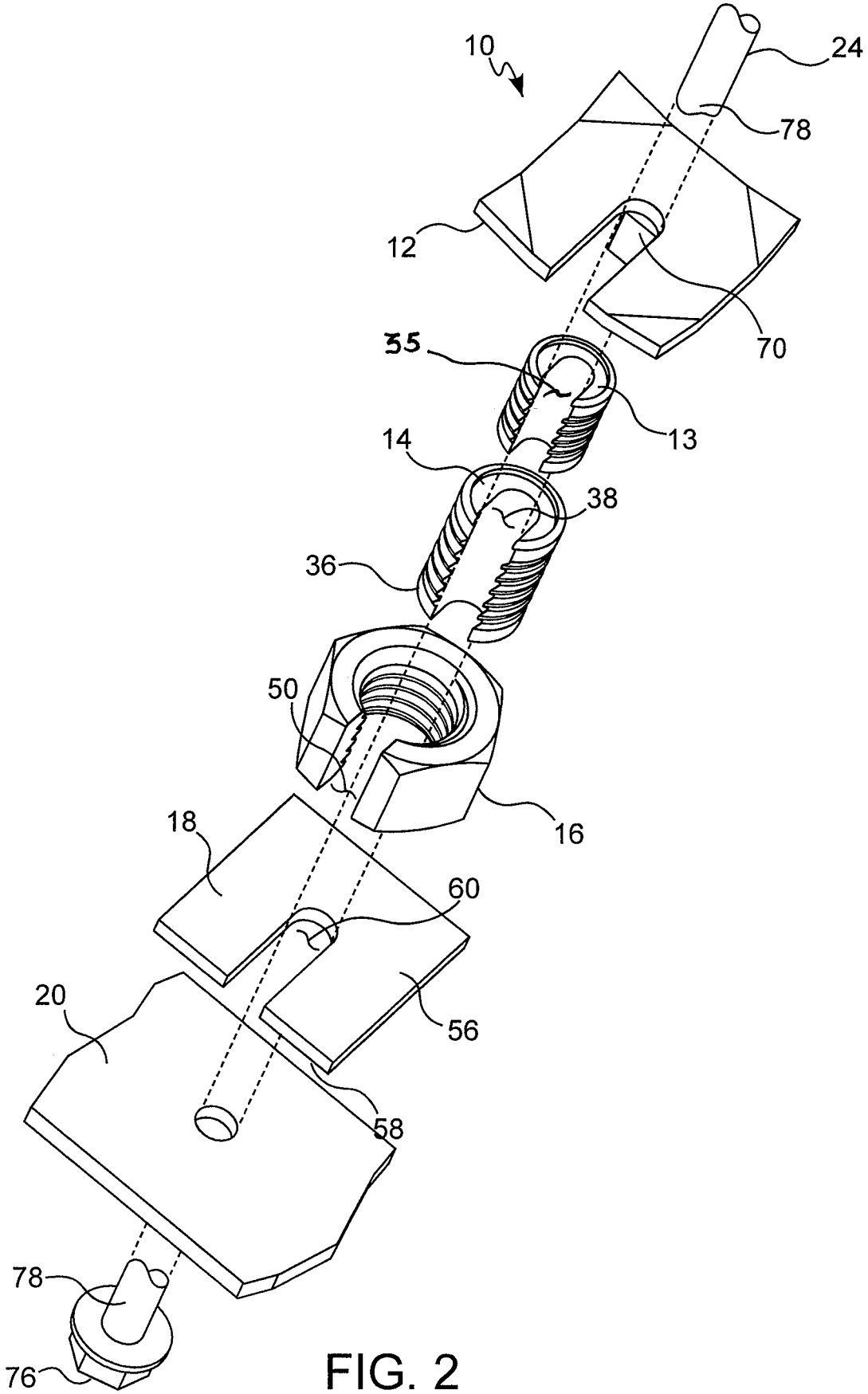
FIG. 2 is an exploded perspective view of the system of FIG. 1 according to one aspect of the present invention.
Figure 3:
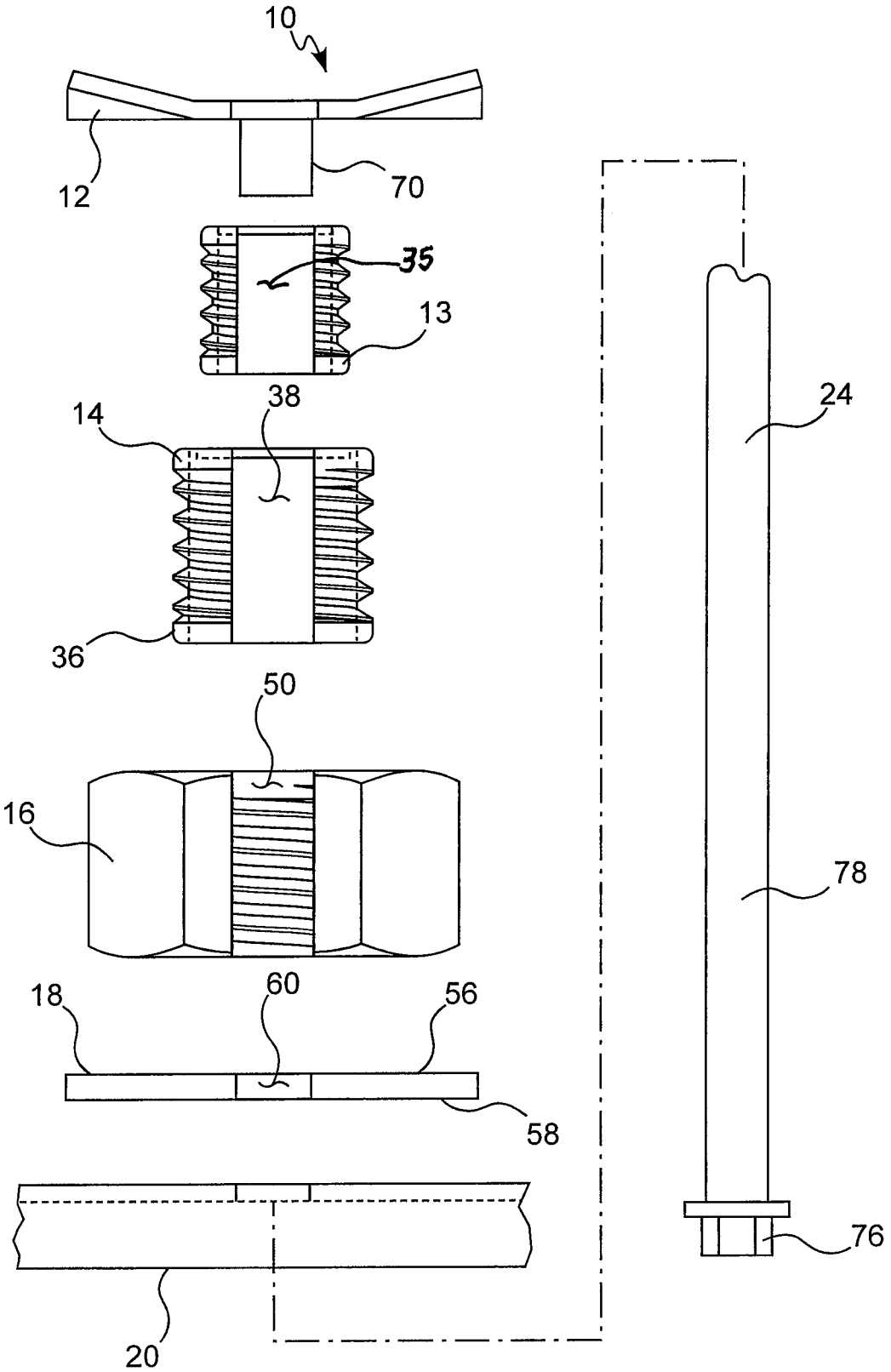
FIG. 3 is an exploded side view of the system of FIG. 1 according to one aspect of the present invention.
Figure 4:
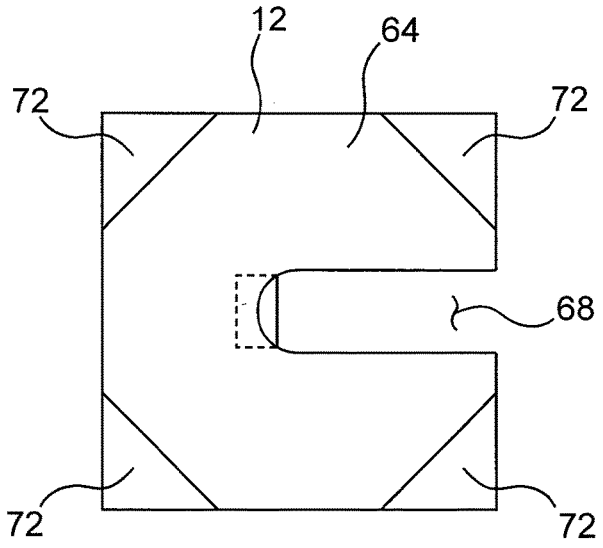
FIG. 4 is a top view of a roof plate of the system of FIG. 1 according to one aspect of the present invention.
Figure 5:
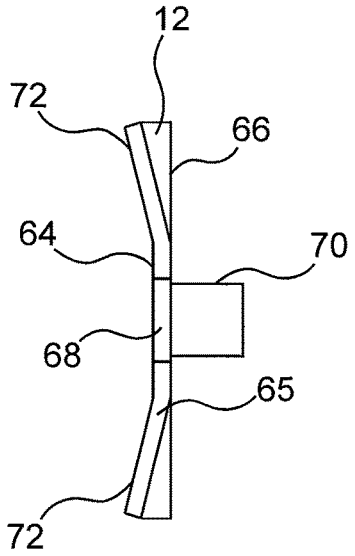
FIG. 5 is a side view of the roof plate of FIG. 4.

Referring now to FIGS. 2, 3, and 19, upon installation, the mine roof bolt 24 extends through the mine roof channel 20 and into the borehole 26 of the mine roof 22 while the head 76 of the mine roof bolt 24 is positioned adjacent to the roof channel 20. The mine roof bolt 24 extends through the spacer plate 18, the nut 16, the spacer 14, and the roof plate 12. When the system 10 is installed in the gap 28 between the mine roof 22 and the channel 20, the mine roof bolt 24 is received within the slot 60 of the spacer plate 18, the slot 50 of the nut 16, the slot 38 of the spacer 14, the slot 68 of the roof plate 12, and, if necessary, the slot 35 of the supplemental spacer 13. In this configuration, the roof plate 12 engages the mine roof surface 22. The spacer 14 or a portion of the spacer 14 is threaded within the nut 16 by engaging the threaded outer surface 36 of the spacer 14 with the threaded inner surface 48 of the nut 16. The key 70 of the roof plate 12 is received within the radially extending slot 38 of the spacer 14, which prevents relative rotation between the roof plate 12 and the spacer 14. The nut 16 may be rotated until spacer plate 18 is engaged with the roof channel 20 and the roof plate 12 is engaged with the mine roof 22 and/or until a predetermined tension is obtained. Depending on the size or height of the gap 28 between the mine roof 22 and the roof channel 20, a specific size spacer 14, nut 16, and/or spacer plate 18 may be selected to ensure the gap 28 is accommodated by the system 10 to re-tension the roof channel 20. A supplementary spacer 13 or multiple spacer plates 18 may also be used to ensure the gap 28 is accommodated by the system 10.

Referring again to FIG. 19, a method for re-tensioning a mine roof channel 20, where the mine roof channel 20 may be held by the mine roof bolt 24 to the mine roof 22, using the re-tensioning system 10 as described above may include the following steps: placing the roof plate 12 between the mine roof channel 20 and the mine roof 22 by inserting a shaft 78 of the roof bolt 24 into the radially extending slot 68 of the roof plate 12; placing the spacer 14 between the mine roof channel 20 and the roof plate 12 by inserting the shaft 78 of the roof bolt 24 into the radially extending slot 38 of the spacer 14; placing the nut 16 between the spacer 14 and the mine roof channel 20 by inserting the shaft 78 of the roof bolt 24 into the radially extending slot 50 of the nut 16; threading the nut 16 onto the spacer 14 while rotation of the spacer 14 to the roof plate 12 is restricted due to the key 70 extending from the roof plate 12 and engaging with the spacer 14; and tightening the nut 16 until the roof plate 12 is firmly pressed against the roof surface 22. The method may also include placing at least one spacer plate 18 between the mine roof channel 20 and the nut 16 by inserting the shaft 78 of the roof bolt 24 into the radially extending slot 60 of the spacer plate 18. The method may also include placing at least one supplemental spacer 13 between the roof plate 12 and the spacer 14.

Although the invention has been described in detail for the purpose of illustration based on what is currently considered to be the most practical and preferred embodiments, it is to understood that such detail is solely for that purpose and that the invention is not limited to the disclosed embodiments but, on the contrary, is intended to cover modifications and equivalent arrangements that are within the spirit and scope of the appended claims. For example, it is to be understood that the present invention contemplates that, to the extent possible, one or more features of any aspect embodiment can be combined with one or more features of any other aspect or embodiment.

The invention claimed is:

1. A system for re-tensioning a mine roof channel held by a mine roof bolt to a mine roof, the system comprising:

a roof plate having a first side, a second side positioned opposite the first side, and a sidewall extending therebetween, wherein the first side is configured to directly contact a surface of the mine roof, and wherein the sidewall defines a radially extending slot configured to receive the mine roof bolt;

a spacer having a first side, a second side positioned opposite the first side, and a sidewall extending therebetween, wherein the first side of the spacer is configured to directly contact the second side of the roof plate, and wherein the sidewall defines a radially extending slot configured to receive the mine roof bolt; and a nut having a first side, a second side positioned opposite the first side, a sidewall therebetween, and a threaded opening, wherein the sidewall defines a radially extending slot configured to receive the mine roof bolt.

2. The system of claim 1, further comprising a spacer plate having a first side, a second side positioned opposite the first side, and a sidewall extending therebetween, wherein the sidewall defines a radially extending slot configured to receive the mine roof bolt, wherein the first side of the spacer plate is configured to directly contact the second side of the nut, and the second side of the spacer plate is configured to directly contact the mine roof channel.

3. The system of claim 1, wherein the spacer sidewall has a threaded outer surface.

4. The system of claim 3, wherein the threaded opening of the nut is configured to directly contact the threaded outer surface of the spacer sidewall.

5. The system of claim 4, wherein the spacer has a thickness of 0.5-3 inches between the first and second sides of the spacer.

6. The system of claim 4, wherein the nut has a thickness of 0.5-3 inches between the first and second sides of the nut.

7. The system of claim 4, further comprising a supplemental spacer having a first side, a second side positioned opposite the first side, and a sidewall extending therebetween, wherein the sidewall defines a radially extending slot configured to receive the mine roof bolt, wherein the first side of the supplemental spacer is configured to directly contact the second side of the roof plate, and the second side of the supplemental spacer is configured to directly contact the first side of the spacer.

8. The system of claim 7, wherein the first side of the spacer defines a recessed surface configured to receive the supplemental spacer.

9. The system of claim 1, wherein the roof plate has a key extending from the second side of the roof plate, and wherein the radially extending slot of the spacer is configured to receive the key to prevent relative rotation between the spacer and the roof plate.

10. The system of claim 9, wherein the key of the roof plate is parallelepiped in shape.

11. The system of claim 10, wherein the roof plate is substantially rectangular in shape having four corners, wherein at least one projection extends from the first side of the roof plate in each of the four corners.

12. The system of claim 1, wherein the roof plate has at least one projection, extending from the first side of the roof plate, wherein the at least one projection is configured to engage with the mine roof surface to prevent movement of the roof plate relative to the mine roof surface.

13. A method for re-tensioning a mine roof channel held by a mine roof bolt to a mine roof, wherein the mine roof bolt comprises a mine roof shaft, the method comprising:

placing a roof plate between the mine roof channel and the mine roof by inserting the shaft of the roof bolt into a radially extending slot of the roof plate;

placing a spacer having a threaded outer surface between the mine roof channel and the roof plate by inserting the shaft of the roof bolt into a radially extending slot of the spacer;

placing a nut between the mine roof channel and the spacer by inserting the shaft of the roof bolt into a radially extending slot of the nut;

threading the nut onto the spacer while rotation of the spacer to the roof plate is restricted; and tightening the nut until the roof plate is firmly pressed against the roof.

14. The method of claim 13, further comprising placing a spacer plate between the mine roof channel and the nut by inserting the shaft of the roof bolt into a radially extending slot of the spacer plate.

15. The method of claim 13, further comprising placing a supplemental spacer between the spacer and the roof plate by inserting the shaft of the roof bolt into a radially extending slot of the supplemental spacer.

16. The method of claim 13, wherein the roof plate comprises a key configured to be received by at least the spacer in order to prevent relative rotation between the roof plate and the spacer.

17. The method of claim 16, wherein the key is parallelepiped in shape.

* * * * *